United States Patent [19]

Wieland, Jr.

[11] 4,060,180

[45] Nov. 29, 1977

[54] TOOL FOR APPLYING ADHESIVE MATERIAL

[75] Inventor: Howard N. Wieland, Jr., Amherst, Ohio

[73] Assignee: TRW Inc., Cleveland, Ohio

[21] Appl. No.: 648,494

[22] Filed: Jan. 12, 1976

[51] Int. Cl.[2] ..... B67D 5/62

[52] U.S. Cl. ..... 222/146 HE; 222/394; 219/230; 219/421; 277/205

[58] Field of Search ..... 222/146 HE, 394; 219/421, 230; 425/376 R

[56] References Cited

U.S. PATENT DOCUMENTS

| | | | |
|---|---|---|---|
| 3,158,376 | 11/1964 | Rentschler | 277/205 |
| 3,277,276 | 10/1966 | Nichol | 219/421 |
| 3,326,415 | 6/1967 | Estabrooks | 219/421 X |
| 3,545,343 | 12/1970 | Orbeck | 222/389 X |
| 3,942,686 | 3/1976 | Roth | 222/146 HE |
| 3,951,308 | 4/1976 | Thirtle | 222/146 HE |
| 3,960,296 | 6/1976 | Nord | 222/146 HE |

*Primary Examiner*—Robert B. Reeves
*Assistant Examiner*—Frederick R. Handren
*Attorney, Agent, or Firm*—Allen D. Gutchess, Jr.

[57] ABSTRACT

A tool is provided for applying adhesive material to a surface. The tool utilizes a cartridge of heat-softenable, thermoplastic material which is positioned in a chamber of the tool. Air under pressure is applied directly to a rear portion of the cartridge to urge it toward a heat block located at a forward end of the chamber. That portion of the adhesive material in contact with and adjacent the heat block is softened and flows through a central discharge passage in the block and past a check valve to a nozzle from which the softened adhesive is directed to a surface to be bonded. The heat block is designed to apply more heat to a central portion of the forward end of the cartridge than to a peripheral portion, in order to promote flow of the heat-softened material toward the discharge passage from the peripheral portion of the cartridge.

9 Claims, 5 Drawing Figures

TOOL FOR APPLYING ADHESIVE MATERIAL

This invention relates to a tool for applying heat-softenable, thermoplastic adhesive material to a surface.

The use of so-called hot-melt adhesives or glue in commercial and industrial operations is finding wider and wider acceptance. The adhesives come in a variety of forms which are heat-softenable at various temperatures and harden under various lengths of time; they also display a variety of characteristics to meet the physical requirements of various applications. The adhesives are employed in cartridge form and applied by portable, adhesive-applying tools in more and more applications.

It has been found that the adhesive cartridge often tends to display a degree of resiliency and tends to buckle or expand against the wall of the chamber in which the cartridge is located, as it is forced toward the heat block by a piston in the chamber. The resulting binding of the cartridge in the chamber can reduce or stop the flow of molten adhesive material from the tool. The cartridge also may be sufficiently tacky that the end must be covered with a release film or paper to prevent adhesion to the piston. In addition, the application of heat through the heat block to the adjacent end of the cartridge is not always as rapid or as efficient as desired, resulting in a long heat-up time and often a relatively slow flow of the adhesive material from the discharge nozzle of the tool.

With the adhesive-applying tool according to the invention, air pressure is applied directly to a rear end of the cartridge and around a rear peripheral portion thereof. This direct application of the air eliminates the buckling or expansion of the cartridge against the chamber wall as has heretofore occurred with the use of a piston to apply the pressure only on the cartridge end. Of course, the cost of the piston is also eliminated. An internal seal can also be provided at an intermediate portion of the chamber to prevent the air from passing thereby to the discharge passage of the chamber and possibly causing the heat-softened adhesive to be emitted from the nozzle in spurts.

The adhesive-applying tool according to the invention also has a specially designed heat block which has raised portions or fins engaging the discharge or forward end of the cartridge in a manner such as to apply more heat to a central portion of that end than to the peripheral portion. This promotes the flow of the heat-softenable adhesive centrally toward that end of the cartridge to a centrally-located discharge passage in the block.

It is, therefore, a principal object of the invention to provide an adhesive-applying tool having the features discussed above.

Another object of the invention is to provide an adhesive-appyling tool having a cartridge chamber in which air is applied under pressure directly to an adhesive cartridge therein to urge the cartridge toward a heat block of the tool.

Yet another object of the invention is to provide an adhesive-appyling tool with a cartridge chamber including a heat block at one end thereof having a central discharge passage and designed to promote flow of adhesive toward the passage from outer peripheral portions of a cartridge near the block.

Other objects and advantages of the invention will be apparent from the following detailed description of preferred embodiments thereof, reference being made to the accompanying drawings, in which.

Figures 1, 2, 3, 4, 5:
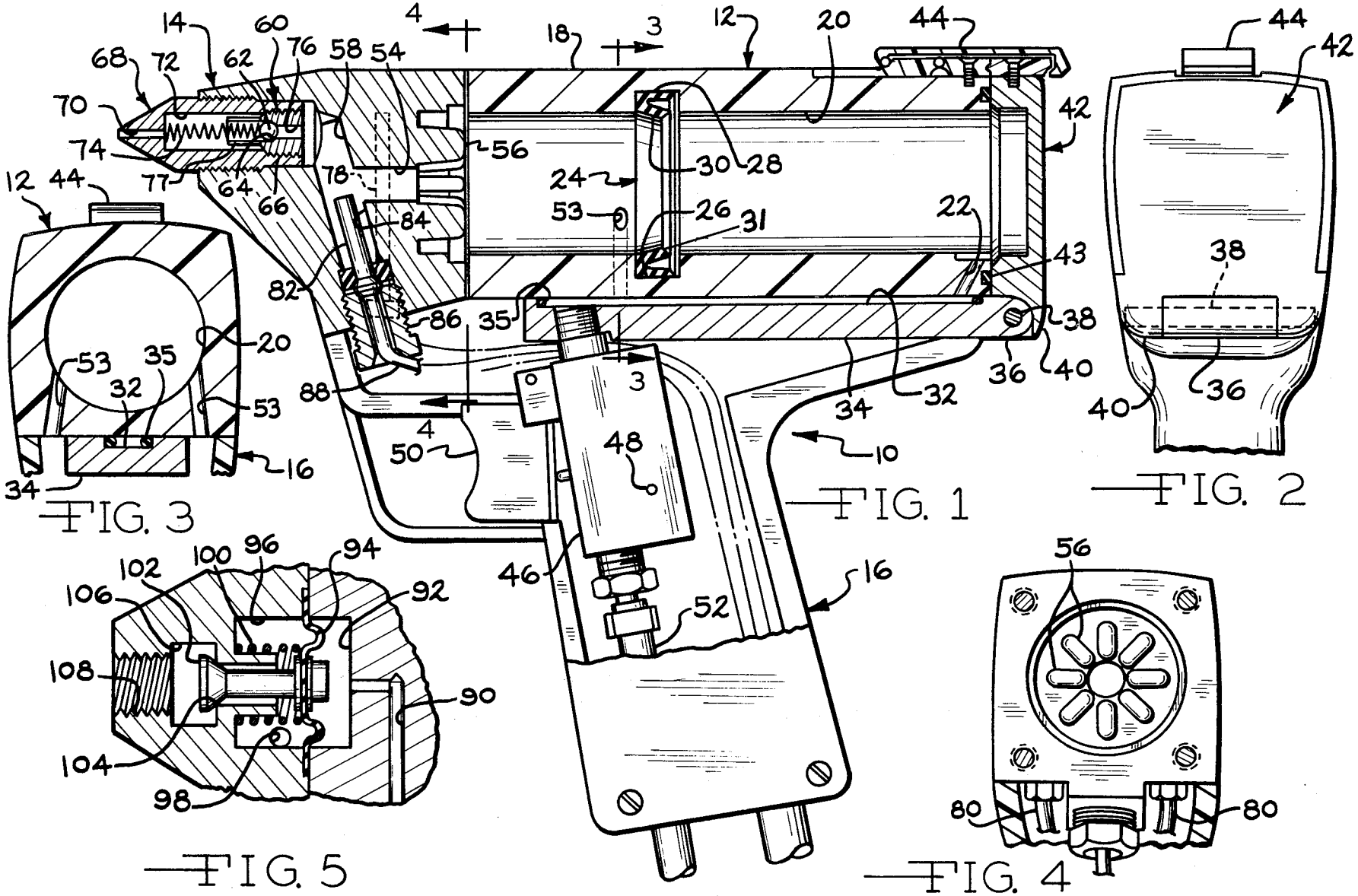
FIG. 1 is a somewhat schematic view in longitudinal cross section, with parts broken away, of an adhesive-appyling tool in accordance with the invention.
FIG. 2 is a fragmentary rear end view of the tool of FIG. 1.
FIG. 3 is a fragmentary view in transverse cross section taken along the line 3—3 of FIG. 1.
FIG. 4 is a fragmentary view in transverse cross section taken along the line 4—4 of FIG. 1.
FIG. 5 is an enlarged, fragmentary view of a modified check valve usable with the adhesive-applying tool.

Referring to the drawings, and particularly to FIG. 1, an adhesive-applying tool according to the invention is indicated at 10. The tool 10 includes three main sections, including an adhesive cartridge-receiving section 12, a heat and discharge section or block 14, and a handle section 16.

The cartridge-receiving section 12 includes an insulating body 18 forming a chamber 20, preferably cylindrical, to receive an adhesive cartridge. The chamber 20 has a rear charge end and a forward discharge end, with the body 18 having an air supply passage 22 communicating with the charge end of the chamber. An intermediate seal 24 is located in an annular groove 26 in the body 18. The seal 24 is made of a resilient material and, in the form shown, includes an outer annular flange 28 seated in the groove 26 and an inwardly-extending resilient flange 30 diagonally projecting into the chamber 20 at an angle toward the rear end thereof from the groove. An annular edge 31 is beveled to slant inwardly toward the discharge end of the chamber 20. The seal 24 engages the periphery of an adhesive cartridge inserted into the chamber 20 to prevent air under pressure supplied through the passage 22 to the rear end of the cartridge from leaking past the cartridge to the discharge end of the chamber 20. The air in the rear portion of the chamber 20 tends to urge the diagonal flange 30 of the seal 24 inwardly against the cartridge to enhance the sealing properties of the seal.

With the air under pressure acting directly on the rear end of the adhesive cartridge, the same air also acts on the cylindrical periphery of the rear portion of the cartridge to the rear of the seal 24. Consequently, the cartridge does not tend to buckle or expand outwardly as has heretofore occurred with cartridges of somewhat rubbery adhesive material when pressure was applied solely to the end of such cartridges by means of a piston. Further, with the seal 24, the air cannot leak past the cartridge toward the section 14 and possibly force the molten adhesive out of the discharge nozzle in spurts. Of course, the direct application of the air under pressure also eliminates the cost of the piston and thereby reduces the cost of the tool.

Air for the cartridge chamber 20 is supplied through the passage 22 from a longitudinally-extending passage 32. The passage 32 is formed in a lower metal bar or part 34 which is suitably fastened, as by six bolts (not shown), to the body 18. A resilient seal 35 is located between the bar 34 and the body 18 around the passage 32. A rearward end 36 of the part 34 extends beyond the end of the body 18 and has a transverse bore receiving a hinge pin 38. The hinge pin 38 also extends through two end ears 40 of a cap 42, the ears being located at opposite edges of the bar end 36. An O-ring or other suitable seal 43 is located between the cap 42 and the rear annular edge of the body 18 to effect an air-tight seal therebetween when the cap is held closed by a commercially-available over-center latch 44.

Air for the passage 32 is controlled by a valve 46 located in the handle 16. When the valve 46 is in the position shown, air in the chamber 20 behind the cartridge is vented through the passages 22 and 32 to a vent opening 48 in the valve. When a trigger 50 connected with the valve 46 is pulled or pressed, air is then supplied through the passages 32 and 22 from a main supply line 52 which extends downwardly through the handle 16 and is connected to a suitable source of air under pressure. Two vent passages 53 (FIGS. 1 and 3) are located on each side of the bar 34 and extend between the chamber 20 forward of the seal 24 and the hollow interior of the handle 16. This prevents any air under pressure from being in the forward portion of the chamber 20 and possibly forcing softened adhesive out the nozzle in spurts. Such might otherwise occur, for example, when the rear end of the adhesive cartridge passed the seal 24.

When the adhesive cartridge is forced against the heat and discharge section 14 by the air under pressure, the adhesive is softened and flows through a discharge passage 54 in the section 14 which is preferably centrally located relative to the end of the chamber 20. A plurality of radially-extending fins 56 project toward the chamber 20 from the section 14. The fins 56 extend outwardly, preferably in a radial pattern, from the discharge passage 54 toward the inner surface of the body 18, but terminate radially inwardly at locations spaced from an imaginary extension of the inner surface of the body 18. The fins, as shown in FIG. 4, are of the same width from the inner to the outer ends and are spaced closer together near their inner ends than toward their outer ends. As a result, there is more metal in contact with the central portion of the end of the adhesive cartridge than with the outer peripheral portion of the cartridge end. This results in a greater concentration of heat toward the central portion of the cartridge end, with the peripheral portion of the cartridge at the plane of the free ends of the fins being out of engagement with the heat and discharge section 14. With this arrangement, the peripheral portion of the cartridge remains substantially solid and the central portion is the most fluid, receiving the greatest concentration of heat. This then maintains a flow of the adhesive toward the discharge passage from the peripheral portions of the cartridge.

At the downstream end of the discharge passage 54, a transverse discharge passage 58 is located to transfer the molten adhesive in the passage 54 outwardly to a check valve 60. The check valve 60 includes a ball 62 normally seated against an annular seat 64 of a threaded insert 66. The insert 66 is threaded into an end of a nozzle member 68 having a nozzle opening 70. The nozzle opening 70 communicates with a central chamber 72 in the nozzle member 68 in which is located a check valve spring 74 which urges the ball 62 against the seat 64. When the adhesive in the passage 58 is under sufficient pressure, it communicates with the ball 62 through a central passage 76 in the insert 66 and forces the ball off of its seat whereby the adhesive can flow through the nozzle 68. The ball 62 is restrained against lateral movement in a guide tube 77. The tube has two diametrically-opposite slots through its length to accommodate the flow of adhesive when the ball is off its seat.

Flow through the nozzle 70 will occur as long as the trigger 50 is pulled and as long as the heat block section 14 is at a proper temperature. When the trigger 50 is released, the air acting directly upon the adhesive cartridge is vented through the opening 48 of the valve 46. This relieves the pressure on the cartridge and enables the check ball 62 to close on the seat 64 immediately and prevent dribble of adhesive through the nozzle opening 70.

The heat and discharge section 14 is heated to an elevated temperature by two electric resistance elements 78 extending upwardly through the section 14 on each side of the discharge passage 54. These are heated by flexible leads 80 (FIG. 4) extending downwardly away from the tool to a suitable source of power. The power to the elements 78 is controlled by a temperature probe 82 which extends through a passage 84 into communication with the discharge passage 54 and the transverse passage 58. The probe is held by a suitable fitting 86 and has leads 88 extending therefrom to a control box which controls the power to the leads 80 of the resistance elements 78. The heat-sensing element 82 can be a thermistor which is commercially available and is used with commercially-available circuitry. The fact that the temperature of the adhesive flowing through the passages 54 and 58 is sensed rather than the temperature of the block or section 14 itself enables closer control to be achieved over the temperature of the adhesive material.

An air-operated check valve is shown in FIG. 5 for controlling the flow of adhesive to the nozzle even more fully. In this instance, air can be supplied through a passage 90 to a diaphragm chamber 92. A flexible diaphragm 94 extends across the chamber 92 and separates it from a forward chamber or passage 96 which receives the molten adhesive material from a suitable discharge passage 98. When there is no positive air pressure in the chamber 92, a spring 100 urges the diaphragm 94 rearwardly to maintain a check valve body 102 against a seat 104. Adhesive in the chamber 96 is thereby restrained and cannot flow through an outlet passage 106 to a nozzle (not shown) threaded in an opening 108. However, when the trigger 50 is pulled and the valve 46 opened, air is supplied both to the rear of the adhesive cartridge and through the passage 90 to the chamber 92. This air, when it is at sufficient pressure, overcomes the force of the spring 100 and opens the valve body 102 to enable the material to flow from the nozzle as the adhesive cartridge is also urged toward the heat and discharge section by the air pressure at the rear thereof.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. An adhesive-applying tool for melting and applying adhesive to a workpiece from a plurality of sequentially fed adhesive cartridges, said tool comprising wall means forming an elongate chamber of substantially uniform cross section throughout its length, heat-conducting means located at one end of said chamber and having an outlet passage communicating with said chamber, said heat-conducting means being effective to heat and melt an end of one of the cartridges in contact with said heat-conducting means at said one end of said chamber, means for closing off the other end of said chamber, resilient sealing means carried by said wall means and extending into said chamber at an intermediate position between said heat-conducting means and said closing means and effective to engage the outer surface of the cartridges of adhesive material inserted into said chamber, said sealing means being fixed and being spaced substantially rearwardly from said heat-conducting means and the melted ends of the cartridges, means for supplying fluid under pressure directly to said other end of said chamber, said sealing means being effective to substantially prevent the passage of fluid under pressure past said sealing means toward said outlet passage, and vent means communicating with said chamber and located proximate said sealing means to vent any fluid under pressure which might leak past said sealing means to prevent the fluid under pressure from directly acting on the molten adhesive to force the molten adhesive from said outlet passage.

2. An adhesive-applying tool according to claim 1 characterized by said means for supplying fluid under pressure comprising a valve having a vent for venting fluid under pressure from said chamber when the valve is closed and the fluid is not being supplied to said chamber.

3. An adhesive-applying tool according to claim 1 characterized by said wall means having an annular groove in which said sealing means is located.

4. An adhesive-applying tool according to claim 3 characterized by said sealing means comprises a resilient flange extending at an angle into said chamber toward said other end of said chamber.

5. An adhesive-applying tool according to claim 4 characterized by the edge of said resilient flange slanting inwardly in a direction toward said heat-conducting means.

6. An adhesive-applying tool according to claim 1 characterized by a heat-sensing element communicating with said outlet passage to sense the temperature of the adhesive flowing therethrough, and an electric resistance element in heat-conducting relationship with respect to said heat-conducting means, power to said electric resistance element being controlled by said heat-sensing element.

7. An adhesive-applying tool according to claim 6 characterized by said heat-sensing element being a thermistor.

8. An adhesive-applying tool according to claim 6 characterized by there being two of said electric resistance elements extending through said heat-conducting means on opposite sides of said outlet passage, said resistance elements being controlled by said heat-sensing element.

9. An adhesive-applying tool according to claim 1 characterized by said heat-conducting means having a plurality of fins projecting generally radially-outwardly from the outlet passage toward an imaginary extension of the wall means forming the chamber, said fins being of substantially uniform thickness from the inner ends adjacent said passage to the outer ends, and being uniformly spaced around said passage but spaced closer together adjacent said passage than at the outer ends.

* * * * *